United States Patent [19]

Fiedler et al.

[11] Patent Number: 4,802,414

[45] Date of Patent: Feb. 7, 1989

[54] MULTIPLE-CONTACT PLUG CONNECTION FOR ELECTRICALLY ACTUATABLE TRIGGERING MEDIA

[75] Inventors: Kurt Fiedler, Diepersdorf; Bernhard Kratz, Wendelstein, both of Fed. Rep. of Germany

[73] Assignee: Diehl GmbH & Co., Fed. Rep. of Germany

[21] Appl. No.: 116,023

[22] Filed: Nov. 3, 1987

[30] Foreign Application Priority Data

Nov. 7, 1986 [DE] Fed. Rep. of Germany ..... 3638084

[51] Int. Cl.[4] ..... F42C 11/00

[52] U.S. Cl. ..... 102/206

[58] Field of Search ..... 102/202.1, 202.2, 206, 102/217

[56] References Cited

U.S. PATENT DOCUMENTS

| | | | |
|---|---|---|---|
| 2,297,006 | 9/1942 | Lohman | 102/217 |
| 3,018,733 | 1/1962 | Johnson | 102/206 |
| 3,343,491 | 9/1967 | Peters, Jr. | 102/206 |
| 4,152,988 | 5/1979 | Haas et al. | 102/202.11 |

FOREIGN PATENT DOCUMENTS

| | | |
|---|---|---|
| 2914975 | 4/1979 | Fed. Rep. of Germany . |
| 3317376 | 5/1983 | Fed. Rep. of Germany . |
| 3431818 | 8/1984 | Fed. Rep. of Germany . |
| 3637988 | 5/1988 | Fed. Rep. of Germany . |

*Primary Examiner*—Charles T. Jordan

*Attorney, Agent, or Firm*—Scully, Scott, Murphy & Presser

[57] ABSTRACT

A multiple-contact plug connection for electrically-actuatable triggering media. The multiple-contact plug connection has an identifying capacitor connected in parallel with each triggering device, whereby the values of the capacitances of the identifying capacitors for different triggering devices will clearly distinguish from each other.

7 Claims, 1 Drawing Sheet

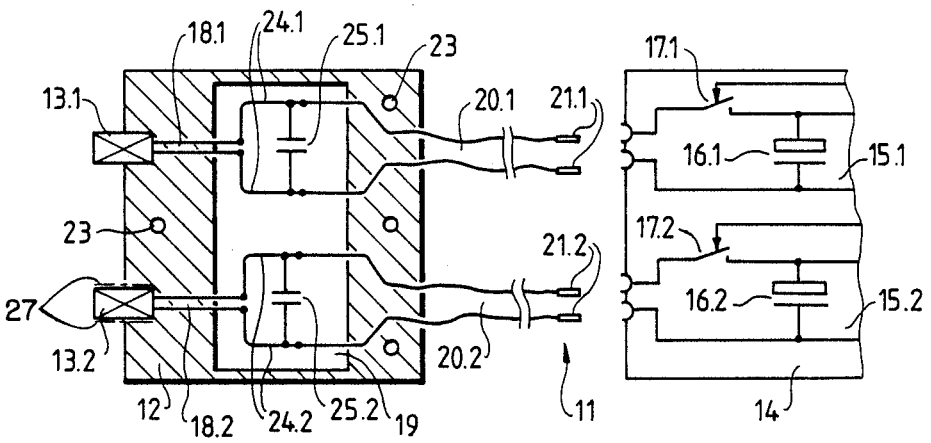
18.1
24.1
25.1
23
17.1
13.1
20.1
21.1
16.1
15.1
23
17.2
21.2
27
16.2
15.2
13.2
20.2
12
18.2
24.2
25.2
19
11
14

MULTIPLE-CONTACT PLUG CONNECTION FOR ELECTRICALLY ACTUATABLE TRIGGERING MEDIA

BACKGROUND OF THE INVENTION

1. Field of the Invention

The present invention relates to a multiple-contact plug connection for electrically-actuatable triggering media.

2. Discussion of the Prior Art

A contact plug connection of the above-mentioned type is required when, for example, in an article of ammunition, for the purpose of program-controlled arming and operational procedures, there are to be triggered pyrotechnic power elements or detonators at different points in time from individual triggering circuits which are associated therewith; for instance, as is known from the disclosure of German Laid-Open Patent Appin. No. 33 17 376.

Because of reasons which are based on production techniques and logistics, the triggering media or devices are frequently cast into a fuze or triggering unit, which is connected with the associated triggering circuits through paired conductors or electrical lines. For an orderly operating sequence it is necessary that the paired conductors of the individual triggering devices are only connected with the associated triggering circuits, whose storage capacitors should be discharged, upon actuation of the trigger switch, through the applicable triggering devices, in order to trigger the latter. Consequently, during the installation and the exchange of the fuze or triggering unit there must be ensured that mistakes or mix-ups will not occur in the electrical connections. This can be attained through so-called coded multiple plugs, in which the individual electromagnetic plug contacts are arranged in a certain nonsymmetrical array or pattern which, as a result, cannot be confused.

However, that type of rigid positioning for the contact plug connector elements (on the one side plug pins and on the other side plug sockets) is excessively space-consuming for small-sized articles of ammunition; for example, such as submunition. As a result, in actual practice, the flexible paired conductors which are associated with the individual triggering devices are individually equipped with plug contact elements without constructively determining their mutually opposite position.

SUMMARY OF THE INVENTION

Accordingly, it is an object of the present invention that pursuant to the foregoing, there is provided a multiple-contact plug connection of the type under consideration, in which it is possible to determine at the connecting ends, during the course of assembly and for purposes of testing, which pair of conductors belongs to which particular triggering device.

The foregoing object is inventively achieved in that the multiple-contact plug connection of the type considered herein has an identifying capacitor connected in parallel with each triggering device, whereby the values of the capacitances of the identifying capacitors for different triggering devices will clearly distinguish from each other.

In accordance with the foregoing inventive object, each of the paired conductors of the contact plug connection which is associated with one of the triggering devices is individualized through an individual capacitance which is connected in parallel with the electrical ignition bridge or gap in the triggering device. These capacitances can possess such a stepped distinction, that even within the framework of the electrical leakages of the components and the uncertainties in the measurements, it is possible to measure clear gradations; as a result of which it becomes possible to determine clear associations with certain triggering devices which have been individualized with respect to their circuit technology; while on the other hand, these capacitances can be dimensioned so small that the electrical discharge behavior of the triggering storage capacitors will not be influenced upon the actuation of the respective triggering device. In addition thereto, it is of advantage that the parallel connection of the small capacitances of these identifying capacitors represents an effective shunting off of high-frequencied interferences directly in the region of the connections between the connecting lines for the detonator and the paired conductors of the multiple-contact plug connection, and as a result that decisively reduces the danger that any leaked-in or introduced high-frequency voltages will lead to an undesired actuation of a triggering device.

BRIEF DESCRIPTION OF THE DRAWING

Additional alternatives and modifications, as well as further features and advantages of the invention, can now be readily ascertained from the following detailed description of an exemplary embodiment of the invention, taken in conjunction with the accompanying single figure of drawing illustrating, in a sectional view, a molded triggering or fuze unit with different wiring for its electrical triggering devices, under a symbolic consideration of their connections to triggering circuits.

DETAILED DESCRIPTION

A multiple-contact plug connection 11 serves for the electrical connection of a fuze or triggering unit 12 with a plurality of triggering devices 13.1, 13.2; for example, two detonators, to a triggering circuit 14 possessing storage capacitors 16.1, 16.2 which can be charged through charging circuits 15.1, 15.2, which capacitors, in response to the individual (mechanical or electrical) actuation of their trigger switches 17.1, 17.2 can trigger a triggering device 13.1, 13.2 respectively associated therewith through discharging of the stored electrical energy therethrough. The connecting lines 18.1, 18.2 of the triggering devices 13.1, 13.2 are connected with flexible paired conductors 20.1, 20.2 through a printed circuit board 19 which, in this instance, serves as a support location, which paired conductors are equipped at their oppositely located ends with the individual elements 21.1, 21.2 (in the illustrated exemplary instance, with socket-plug pins) of the multiple-contact plug connection 11. In the interest of obtaining a savings in space and for an easier manipulatability during manufacture or detaching of the connection, notwithstanding the now shorter lengths of the paired conductors 20.1, 20.2, the contact plug connector element 21.1, 21.2 are not mechanically combined within a contact plug insulating material substrate or carrier, but are individually connected with the paired conductors 20.1, 20.2, and are thereby movable with respect to each other.

Inasmuch as the triggering unit 12, inclusive of the connection of the paired conductors 20.1, 20.2 to the connecting lines 18.1, 18.2 for the triggering devices across the printed circuit board 19, due to reasons of mechanical stability and for protection against environmental influences, are hermetically cast with plastic material into a mounting block with mechanical mounting elements 23 (for example, in the shape of retaining projections or fastening apertures), in the event of any doubts with regard to the association of certain pairs of contact plug elements 21.1, 21.2 with a certain one of the triggering devices 13.1, 13.2, the correct association cannot be visually verified. A continuity test by means of an ohmmeter would be only permissible, since the measuring current flows across the triggering path and the triggering device 13.1, 13.2 could be inadvertently triggered, when a defined measuring current is not exceeded; however, since in actual practice the triggering device 13.1, 13.2 possess about the same triggering bridge or gap impedances, it is not possible to obtain a clear distinction with the use of an ohmmeter. A color marking of the paired conductors 20.1, 20.2 with the prerequisite of the color association with certain triggering devices 13.1, 13.2 would be inadequate, inasmuch as within the cast triggering or fuze unit 12 there can no longer be present any subsequently testable interchanges upon the connection of the paired conductors 20.1, 20.2 across the printed circuit board 19 to the detonators 13.1, 13.2.

In consequence thereof, pursuant to the present invention, it is contemplated that on the printed circuit board 19 each detonator or triggering device 13.1, 13.2 be equipped between the connecting conductor paths 24.1, 24.2 with an individually calibrated identifying capacitor 25.1, 25.2 of lower but among each other clearly distinguishable capacitance. When it is prescribed, from the requisites of production, that a triggering device 13.1, built in at a certain location in the triggering or fuze unit 12, is to be equipped on its connecting printed circuit board 19 with the parallel circuit of an identifying capacitor 25.1 possessing a predetermined capacitance, prior to the paired conductors 20.1, 20.2 being connected thereto and the triggering unit 12 being encapsulated in plastic material, whereby there are permissible only clearly mutually differing (for example, separated by one magnitude or tenth-power) capacitance value on a printed circuit board 19 for the different identifying capacitances 25.1, 25.2, then at any time later on, by means of a capacitance measuring device (in which because of safety reasons there are provided current and voltage limiting circuits), there can be made internal measurements without the danger of an inadvertent electrical activation of one of the triggering devices 13.1, 13.2 from the contact plug connection 11 into the triggering fuze unit 12, so as to, on the one hand, locate the applicable pair of the contact plug elements 21.1, 21.2 and, on the other hand, their association with a certain one of the triggering devices 13.1, 13.2, and thereby also with a certain (namely, associated) trigger switch 17.1, 17.2 for the triggering circuit 14. In that manner, there are uncovered or avoided mix-ups between the plug elements during connections to the triggering circuit 14, and thereby erroneous actuations of triggering devices 13.1, 13.2 during subsequent armed operation.

The still contemplatable source of errors which can be encountered through the connecting in of a capacitor 25.1, 25.2 which deviates from the specification, to a predetermined pair of conductors 20.1, 20.2 on the printed circuit board 19 can be avoided, and concurrently there can be realized a compact construction when instead of, on the one hand, a discrete formation of the triggering bridge or gap in the triggering device 13.1, 13.2, and on the other hand, that of the identifying capacitor 25.1, 25.2, these two elements are combined. This can be effected in general when the triggering device 13.1, 13.2 is directly constituted of a ceramic capacitor, whose coatings, on two mutually oppositely located ceramic surfaces (shown in phantom at 27), are, for example, electrically interconnected about a capacitor edge by means of a triggering bridge wire which is soldered to the coatings; as described in more extensive detail in the copending and concurrently filed German patent application DE No. 3,637,988 entitled "Triggering Component". In this manner, there is achieved that the triggering device 13.1, 13.2 is directly individualized through the capacitance of a capacitor 25.1, 25.2, so as to no longer require any individualizing circuitry, and thereby eliminating further potential sources of error.

Inasmuch as the capacitances of the identifying capacitors 25.1, 25.2 are in the magnitude of nanofarads, and are thereby lower by a number of magnitudes or tenth powers than the capacitances of the trigger circuit-storage capacitors 16.1, 16.2 which lie in the microfarad range, the identifying capacitors 25.1, 25.2 do not lead to a diminishing influence over the timewise discharging sequence of the storage capacitors 16.1, 16.2 through the triggering devices 13.1, 13.2, which in the interest of obtaining a clear and rapid response, should be actuated with a steep current curve. On the other hand, there is obtained by a desirable effect, in that the identifying capacitors 25.1, 25.2 which are individually connected in parallel with the triggering devices 13.1, 13.2, form a short-circuit for high-frequencied energy components, which are introduced without any electrical lines from interference sources, or which can be fed in through the paired conductors 20.1, 20.2, and in the absence of any protective measures against interferences, can lead to a triggering of individual ones of the triggering device 13.1, 13.2 without any external actuation. Thus, there is obviated the need for the complex realization of L-C-Pi-Filters which, in addition to the technological demands on circuitry, are also subject to the disadvantage that the series inductivities lead to a flattening of the current shock-wave front which is diminishing for the response behavior of the triggering devices 13.1, 13.2 during the discharge of a triggering circuit-storage capacitor 13.1, 13.2.

What is claimed is:

1. A multiple-contact plug connection for multiple electrically actuatable triggering devices, comprising an identifying capacitor connected in parallel with each said triggering device, with each identifying capacitor having a different value of capacitance from each other identifying capacitor, such that each particular triggering device can be positively identified by measuring the capacitance of the identifying capacitor associated therewith, whereby the values of the capacitances of the identifying capacitors for different triggering devices clearly distinguish from each other.

2. A multiple-contact plug connection as claimed in claim 1, wherein the multiple contact plug connects each triggering device to a trigger circuit for the triggering device, with each trigger circuit having an associated storage capacitor, and wherein the capacitance of each identifying capacitor is lower by a plurality of tenth-powers than the capacitance of the storage capacitor of the trigger circuit.

3. A multiple-contact plug connection as claimed in claim 1, wherein the identifying capacitors are mounted on a printed circuit board, on which connector conductors for the triggering devices are connected with paired conductors for the multiple-contact plug connection.

4. A multiple-contact plug connection as claimed in claim 1, wherein the identifying capacitors are connected in a hermetically-closed triggering unit to connector conductors of the triggering devices and to paired conductors of said multiple-contact plug connection.

5. A multiple-contact plug connection as claimed in claim 1, wherein said multiple-contact plug connection is equipped with coupling elements at the exposed ends of paired conductors which are movable with respect to each other and which extend from a cast triggering unit.

6. A multiple-contact plug connection as claimed in claim 1, wherein each identifying capacitor comprises a triggering bridge support as an integral component of a triggering device.

7. A multiple-contact plug connection as claimed in claim 1, wherein the capacitance of each identifying capacitor is concurrently designed as a capacitive shunt for shunting-off of leaked in or conducted in high-frequency interference voltages.

* * * * *